United States Patent [19]

Eakes

[11] 4,097,974

[45] Jul. 4, 1978

[54] METHOD AND APPARATUS FOR SIMULTANEOUSLY DYEING YARN AND FORMING YARN PACKAGE

[76] Inventor: James H. Eakes, P.O. Box 609, Cartersville, Ga. 30120

[21] Appl. No.: 480,024

[22] Filed: Jun. 17, 1974

[51] Int. Cl.[2] ..... B65H 54/82; D06P 5/00

[52] U.S. Cl. ..... 28/169; 28/290

[58] Field of Search ..... 28/169, 289, 290; 8/155; 242/159, 163, 54 R; 68/205; 101/172, 211; 53/116

[56] References Cited

U.S. PATENT DOCUMENTS

| | | | |
|---|---|---|---|
| 3,234,627 | 2/1966 | Russo | 28/289 |
| 3,981,055 | 9/1976 | Eakes | 28/290 |

*Primary Examiner*—Louis K. Rimrodt

*Attorney, Agent, or Firm*—Jones, Thomas & Askew

[57] ABSTRACT

A method and apparatus of random or space dyeing yarn while simultaneously forming a yarn package having a plurality of axially stacked revolutions of yarn, with each revolution formed to include a plurality of sinuous patterns in each revolution, and wherein the sinuous pattern of adjacent revolutions are angularly offset relative to each other. The apparatus includes a frame support means having a power driven turntable, with a pressure plate non-rotatable supported thereabove for vertical translating movement, and wherein the yarn package is formed between the rotatably turntable and the pressure plate. The yarn packaging apparatus is provided with yarn guide means for effecting radial reciprocating displacement of yarn while feeding the yarn through a radial slot in the pressure plate to the turntable for forming revolutions of yarn having the sinuous pattern. A number of radially spaced dye ejector nozzles supported on the pressure plate and operable for applying various color dye material to radially spaced portions of each revolution of the yarn package, concurrently with the formation of each revolution. A yarn package is formed and dyed by threading a length of yarn through the yarn guide means, engaging an end of the yarn with the rotary turntable and effecting rotation of the turntable to form the stacked revolutions of yarn while simultaneously applying dye to radially spaced portions of each revolution.

9 Claims, 6 Drawing Figures

METHOD AND APPARATUS FOR SIMULTANEOUSLY DYEING YARN AND FORMING YARN PACKAGE

BACKGROUND OF THE INVENTION

This invention relates to a method and apparatus for dyeing yarn and is more particularly concerned with the method and apparatus for multi-color random or space dyeing yarn while simultaneously forming skein yarn packages.

Space or random dyeing of yarn packages is by now a well established technique used particularly to impart color in tuffted carpets, wovens and knits. Its major attraction is the fact that random color effects are produced thus avoiding formation of the discernable design repeat.

Interest in skein dyeing is increasing because fashion trends are still very much oriented toward fancy yarn effects. Other special effects are obtained by technique like spray printing of yarn, differential dyeing and space dyeing.

Most of the methods employed in the industry utilize either a dip dyeing process, clip dyeing process, knit-de-knit process, printing process or yarn package impregnation process.

A dip dyeing process is one in which portions of the yarn package is dipped in a dye solution, a clip dyeing process is one in which metal clips are attached to the yarn package during dyeing to produce a resist effect.

In the knit-de-knit process, the yarn is knitted into tubing and then roller or vigoreaux printed. In the yarn package impregnation method, the dye is injected into the yarn package by hyperdermic needles using various colors as desired.

In the printing of webs of yarns, usually a number of rollers capable of applying various color combinations are utilized wherein the web of yarn is selectively engaged with certain of the rollers to produce a random or space dyed pattern.

Each of the above processes utilized for random or spaced dyeing of yarn or undesirable for the reason that the process does not afford good reproductability, is not capable of sufficiently high production speed and is uneconomical to carry out.

A considerable amount of yarn used in the textile industry is would on cones, which are then processed to form a skein, with the skein being used for treating the yarn in a number of processing operations, such as heat setting. There have been a number of prior art apparatus designed which will form a skein of yarn wherein each revolution of a skein is parallel, causing substantial contact with adjacent yarn revolutions. One problem of this type of yarn skein is that the porosity of the yarn package is very dense which will obstruct impregnation of yarn treating media.

There have been a number of attempts to provide a yarn skein package having sufficient porosity to permit yarn treating material to effectively impregnate the revolutions of yarn. One of these prior art yarn packages is formed by making a number of small revolutions of yarn and then successfully applying these small revolutions in a circular path about the axis of rotatable support means, with the plurality of revolutions forming a vertical stacked skein consisting of a number of smaller revolutions. The major disadvantage of this type of yarn package occurs when it is necessary to remove the yarn from the skein package for rewinding the yarn on additional support means, wherein the small revolutions of yarn become tangles, requiring the machine to be stopped.

Another problem with the prior art skein forming apparatus is that a number of skeins are formed simultaneously on a frame support means which is provided with a common drive and control means. After a skein package is formed a doffing operation is effected by stopping the machine and removing the skein. The doffing of the skein from these prior art apparatus requires considerable machine down-time, which substantially reduces the skein production of the machine.

Another problem with the prior art skein forming apparatus is in the backwinding of the skein to cones of material. The prior art backwinding operations requires that the yarn be exhausted from one skein of material and that an additional skein be connected with the machine in a stopped position.

A further problem with the prior art skein packages results from the interwoven length of material used to hold the yarn package together, which yarn package easily becomes disarrayed causing the center opening to be difficult to locate when it is necessary to position the center opening on yarn handling means.

In utilizing all the above mentioned prior art methods and apparatus for dyeing yarn and forming shein yarn packages, independent dyeing and yarn packaging machinery are used, which requires separate operations thereby increasing the cost of processing yarn.

SUMMARY OF THE INVENTION

It is therefore a primary object of the present invention to provide a method and apparatus for random or space dyeing yarn while simultaneously forming a skein of yarn which includes sufficient porosity to permit ready impregnation of yarn with treatment medium.

Another object of the present invention is to provide a yarn packaging apparatus which will form a plurality of revolutions of yarns in a axially stacked array with each revolution having a plurality of circumferentially spaced sinuous waves and with the sinuous waves of adjacent revolutions being angularly offset relative to each other; and wherein various color dye materials are applied to random by spaced portions of each revolution in response to development of the vevolutions.

Yet another object of the present invention is to provide a yarn packaging apparatus which is simple to doff and easy to load on skein handling apparatus.

A still further object of the present invention is to provide an improved yarn package having a number of various length yarn revolutions with randomly spaced color combinations.

An additional object of the present invention is to provide a method and apparatus for dyeing yarn and simultaneously packaging yarn in a skein which is simple in construction and use, economical to manufacture and reliable in performance.

The above indicated prior art disadvantages have been overcome and the desirable objects are obtained by the present invention which basically includes a rotatable turntable operable for developing a number of stacked revolutions of yarn to form a skein package, and wherein each revolution of yarn includes a plurality of sinuous patterns, with adjacent sinuous patterns being angularly offset relative to each other to provide an open porosity package of yarn; and wherein means is provided for applying various color dye material to random spaced portions of each revolution while the revolutions are being developed.

These and other objects and advantages of the details of construction will become apparent after reading the following description of the illustrative embodiments, with reference to the accompanying drawings wherein like reference numerals have been used to refer to like parts throughout the several figures and wherein:

DESCRIPTION OV THE ILLUSTRATIVE EMBODIMENT

Figure 1:
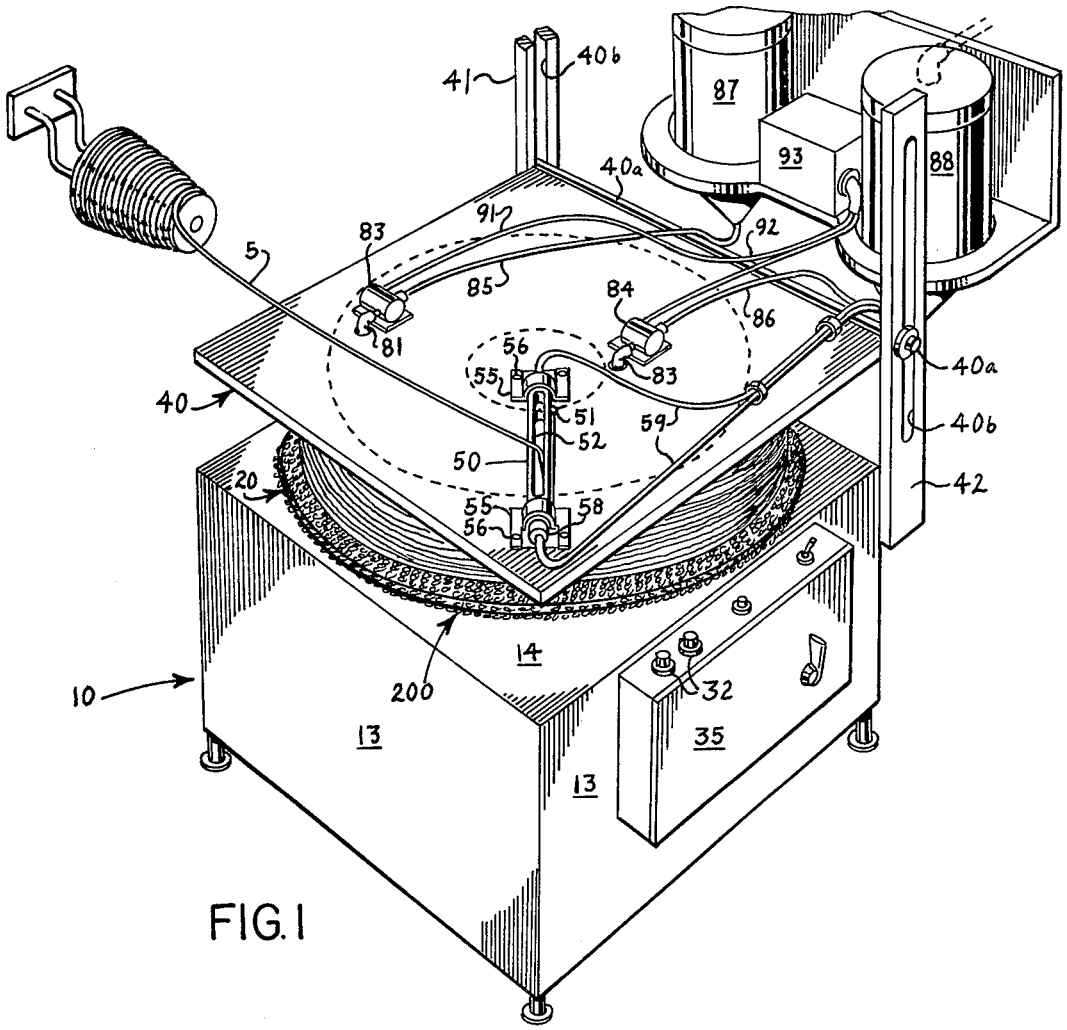
FIG. 1 is a perspective view of a yarn packaging and dyeing apparatus embodying the principles of the present invention.

Referring to the drawings, the yarn packaging and dyeing apparatus is shown and generally represented by the reference numeral 10. The yarn packaging apparatus includes a base frame and housing support means constructed to include a number of vertically extending structural members 11 which are interconnected by a number of horizontally extending structural members 12. The structural members 11, 12 are constructed of conventional metal stock material which are interconnected to each other by conventional means, such as welding (not shown).

A sheet metal housing, including sidewalls 13, topwall 14 and bottomwall 15, is provided around structural members 11, 12, with the sheet metal walls being connected thereto by conventional sheet metal screw means (not shown) whereby access of the interior can be gain for servicing the motor drive and control means, as will be described in more detail below.

Figure 3:
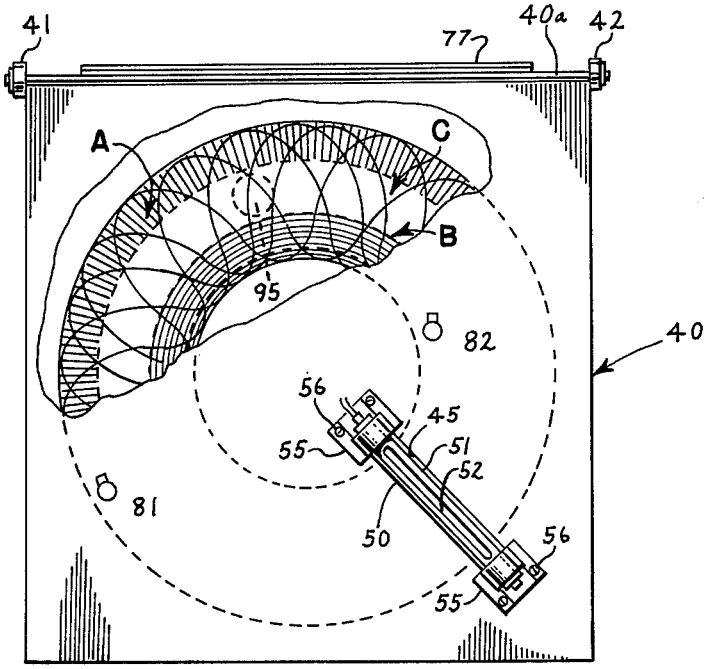
FIG. 3 is a top plan view of the apparatus shown in FIG. 1, with certain parts broken away and shown in sections for purpose of clarity.
Figure 2:
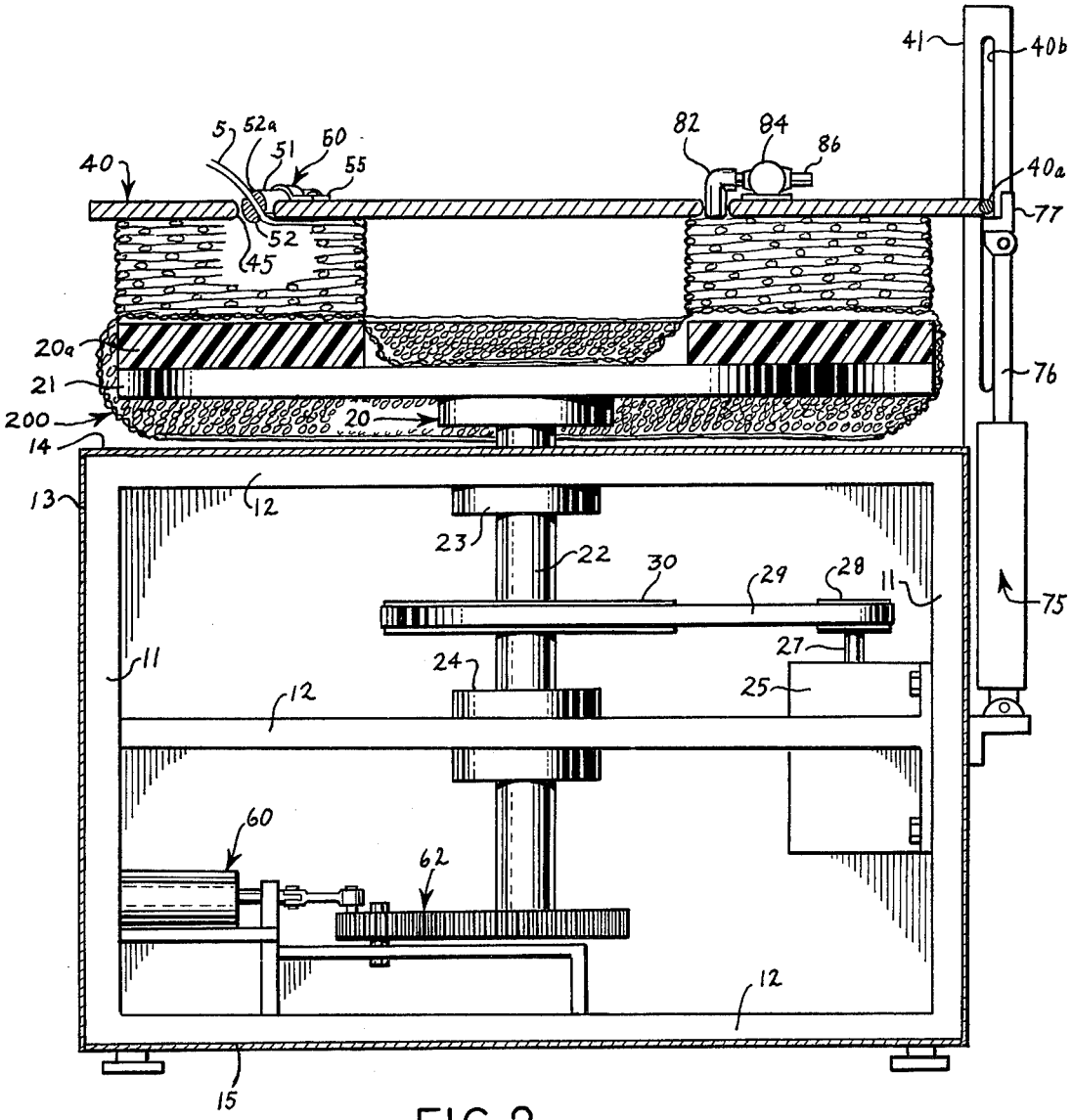
FIG. 2 is a vertical sectional view of the apparatus shown in FIG. 1, with certain parts omitted for purpose of clarity.
Figure 4:
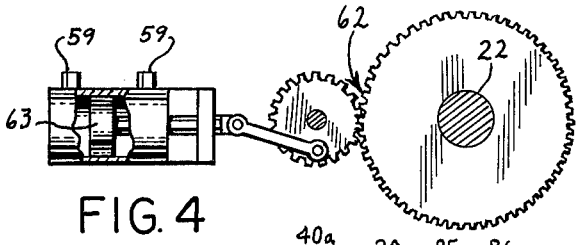
FIG. 4 is a fragmentary sectional view taken along lines 4—4 of FIG. 2; and, FIG. 5 is an enlarged plan view of a dyed length of yarn.

As shown in FIGS. 1 and 2, a turntable means 20 is supported on the frame means for rotation about a substantially vertical axis. The rotary turntable means 20 includes a circular plate element 21 which is supported on the upper end of a vertical support shaft 22. Vertical support shaft 22 is rotatably supported in a pair of vertically spaced bearings 23, 24. Bearings 23, 24 are secured to horizontal frame members 12, as shown in FIG. 1, by conventional bolt connecting means (not shown). Turntable 20 is rotated during cyclic operation of the yarn packaging operation by a conventional electric motor 25 secured to the frame support means by conventional connecting bolts 26. Motor 25 is provided with a drive shaft 27 having a drive pulley 28. Drive pulley 28 is connected by a drive belt 29 to pulley 30 which is fixed to the turntable drive shaft 22. Motor 25 is controlled in an "on" and "off" drive relationship by a conventional switch means 32 located on a control panel 35 mounted on housing side 13. Operation of motor 25 will effect rotation of turntable 20 in a counterclockwise direction, as shown in FIG. 3.

As shown in FIG. 1, the turntable plate 20 is provided with an annular pad member **20*a* concentrically supported relative to the drive shaft axis 22 and includes an upper support surface vertically spaced above the turntable plate. The annular pad 20*a*** is constructed of conventional synthetic material.

The yarn packaging apparatus includes a square-shaped pressure plate 40 which is constructed of conventional metal stock material and is supported above the turntable 20 for non-rotating, vertical translating movement by a pair of upstanding post members 41, 42. Post members 41, 42 are secured to the frame means by conventional means, such as welding.

As shown in FIGS. 1 and 2, the pressure plate 40 is provided with a transverse pivot shaft **40*a* with opposite extending ends slidably supported in vertically oriented slots 40*b* formed in post members 41, 42, and are detailed to permit both vertical translating and pivotal movement of the pressure plate 40 above the turntable 20**.

Pressure plate 40 is provided with a radially spaced, radially extending yarn feed slot 45 through which yarn is introduced to the area between the turntable and the pressure plate for effecting a buildup of a yarn package. The radial dimension of slot 45 is substantially equal to the radial dimension of annular supporting pad **20*a*. The yarn is introduced and guided through the slot 45 by means of yarn guide means 50**.

The yarn guide means 50 includes an elongated rod member 51 having an axially elongated slot 52 extending radially through the rod member, with the slot being detailed in dimensions to permit a continuous length of yarn 5 to be guided therethrough in a yarn handling operation. Slot 52 includes beveled surface portions **52*a* which define a yarn entrance presenting smooth rounded surfaces for guiding the yarn through slot 52. The elongated rod guide member 51 is adapted to be supported on a plate member 40**.

As shown in FIG. 2, the elongated rod member 51 is supported on plate 40 whereby the bottom surface of the rod is substantially aligned with the bottom surface of plate. The elongated rod member 51 is supported on plate 40 by a pair of U-shaped bracket members 55. The bracket members 55 are attached to plate 40 by conventional screw means 56. The base portion of U-shaped bracket 55 is provided with a shaped rod receiving portion, with the shaped rod receiving portion being provided with locking screw means 57 operable for effectively locking the elongated rod member to brackets 55 to prevent any unwanted displacement of the rod guide member relative to the plate 40.

The elongated rod member 50 is provided with air jet applicator means generally represented by the reference numeral 58. The air jet applicator means 58 includes conventionally externally threaded bushing which is thredably received in complimentary internal threaded openings provided in opposite ends of rod 51. Rod 51 is provided with axially extending passageways which permit air flow communication between the air jet applicator means 58 and the elongated slot means 52. The air jet means 58 are connected by suitable air flow conduit means 59 to a control assembly. The control assembly includes a conventional cyclically operated cylinder means 60 which is operatively connected to gear drive means 62. The gear drive 62 is operatively connected to shaft 22 whereby rotation of shaft 22 will control cyclic rate of operation of the cylinder means. The cylinder means 60 includes a piston 63 operable when reciprocated for developing alternate increased and reduced pressure on opposite sides of the piston, which alternate pressures are transferred simultaneously through conduit means 59 to the jet applicator means 58 located adjacent opposite ends of slot 52. As a length of yarn is drawn through slot 52, control cylinder 60 is operated such that a first air jet or rapidly increased air pressure is applied to one axial end of slot 52, simultaneously with application of reduced air pressure to the opposite end, causing the rapidly increased air pressure and reduced air pressure to displace the length of yarn axially along slot 52 a predetermined amount or until the length of yarn contacts the opposite end of the slot. Control cylinder 60 is cyclically controlled by the gear drive 62 such that simultaneously with the approach of the length of yarn to the opposite end of the slot, the air applicator or air jet means located adjacent that end is operated to effect application of rapidly increased air pressure against an opposite diametrically opposed surface of the yarn while the reduced air pressure is applied to the other jet means, causing displacement of the yarn in an opposite direction from which it arrived. Control cylinder 60 is detailed in cyclic operation such that the two air jet applicator means 58 are successfully operated alternately with the combination of rapidly increased and reduced air pressure whereby the length of yarn will be reciprocally displaced along the length of slot 52.

The cyclic rate or number reciprocal displacements of the length of yarn can be adjusted by controlling the cyclic rate of operation of the control cylinder 60 through adjustment of the gear ratio 62.

As shown in FIG. 2, a conventional phneumatic cylinder 75 is connected at a base portion to the housing sidewall with the cylinder piston rod 76 being connected to a transverse angle member 77 supported beneath the pressure plate pivot shaft 45. Convention valve control means (not shown) is provided for controlling operation of cylinder 75 whereby the cylinder can be used to aid in lifting pressure plate 40 in a doffing operation. The pressure plate 40 is not connected to angle member 77 and is free to move up in a package forming and dyeing operation.

As shown in the drawings, the apparatus includes means for applying dye material to each revolution of the yarn package simultaneously with formation of the yarn package, with the dye material being applied to produce a random space dyed effect to the yarn. The dye applying means includes two dispensing nozzles 81, 82 which are mounted on the upper surface of the pressure plate 40. The nozzles 81, 82 are supported on the pressure plate and operable for dispensing dye material through openings provided in the pressure plate, with nozzle 81 located adjacent the outer periphery of the yarn package (FIG. 2) and nozzle 82 located adjacent the inner periphery of the yarn package or any other arrangement of relative positions of nozzles 81, 82 within the radial dimensions of the yarn package to obtain the desired results. The closer the nozzles are to the outer periphery of the yarn package, the longer the space of the dye color applied. Nozzles 81, 82 are provided with electromagnetically operable valve means 83, 84 and input supply conduits 85, 86, respectively. Supply conduits 85, 86 are connected to dye material storage containers 87, 88 located on a support platform 89 mounted on wall means (not shown). The supply containers are supported at an elevated position where the dye material can flow by gravity to the dispensing nozzles. However, the containers 87, 88 can be provided with input pressure connecting means 90 (shown in dotted lines in FIG. 3) so that additional pressure can be applied to the dye material to aid in transfer to the dispensing nozzles. The pressure connection 90 would be connected to conventional air compressor means (not shown).

As shown in FIG. 1, the electromagnetic controlled valve means 83, 84 are connected by lead lines 91, 92 to control means 93 which is operable for controlling the cyclic rate of the opening and closing of valves 83, 84. The control means 93 is of conventional construction and includes electronic switch means (not shown) which is operable for transferring electronic pulses to the control valves 83, 84 whereby they can be cyclically controlled for periodic dispensing of dye material a number of times in each revolution of turntable 20.

The width of the circular paths A, B of dyed material is related to the volume of dye applied and the pulsation of the valve means 83, 84 is used to control the volume which is usually controlled in a volume per time ratio.

Figure 5:
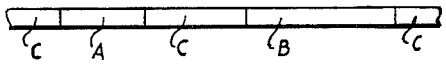

The dispensing nozzles 81, 82 are operable for applying dye material to predetermined circular paths to each revolution of the yarn package simultaneously with the formation of each revolution. Due to the wave pattern in each revolution, the length of yarn will have various angularly oriented radial dimensions and as the wave pattern of yarn passes under the dispensing nozzles 81, 82, a predetermined radial width of dye material will be applied to each revolution to produce circular paths A. B (FIG. 2) of dye material in response to rotation of the turntable 20. The dyeing operation shown in the drawings are carried out on yarn material which has been previously dyed a base color C and by dispensing different color dye material through nozzles 81, 82, the resulting dyeing operation will produce three colors A, B and C of dyed yarn and due to the wave pattern in the yarn the spacing of the different colors will varry (FIG. 5) to produce a random space dyed effect. Further, the yarn can be completely dyed simultaneously with formation of the yarn package and this would eliminate the operation of dyeing the base color prior to forming the yarn package. A complete yarn dyeing operation simultaneously with package formation is effected by providing the number of nozzles necessary to produce the desired colors and to span the radial dimension of the yarn package.

Additional nozzles, such as the nozzle 95 (shown in dotted lines in FIG. 2) could be provided and supplied with the additional colors of dye material to dye the intermediate circular path C (FIG. 2) additional color combination.

Figure 6:
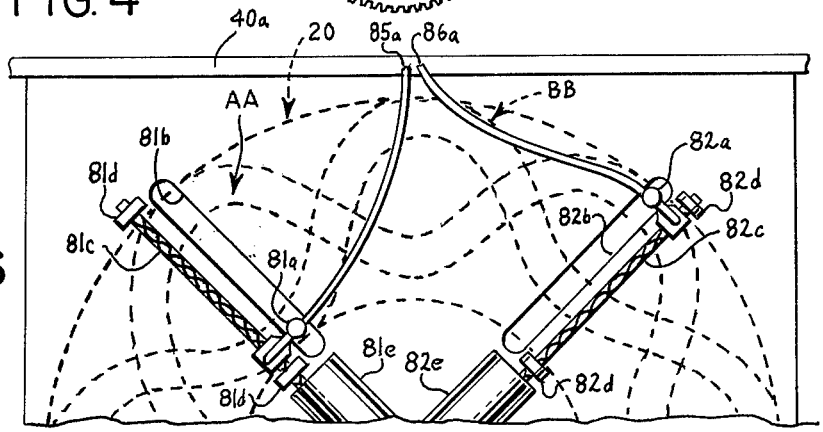
FIG. 6 is a fragmentary top plan view of similar to FIG. 3 showing a modified arrangement of dye dispensing apparatus.

As shown in FIG. 6 a modified arrangement of dye dispensing apparatus is provided which includes two movable dispensing nozzles 81*a*, 82*a* supported adjacent and operable for dispensing dye material through radially arranged elongated slots 81*b*, 82*b*, respectively. Nozzles 81*a*, 82*a* are supported for radial reciprocating movement by a conventional helical grooved shafts 81*c*, 82*c*. Shafts 81*c*, 82*c* are journaled in upstanding brackets 81*d*, 82*d* and are operatively connected to electric drive motors 81*e*, 82*e*. Motors 81*e*, 82*e* and helically grooved shafts 81*c*, 82*c* are operable for effecting radial reciprocating movement along the length of slots 81*b*, 82*b*.

Nozzles 81*a*, 82*a* are connected by supply lines 85*a*, 86*a* to dye supply sources whereby dye material can be dispensed through nozzles 81*a*, 82*a* and slots 81*b*, 82*b* onto yarn supported therebeneath. In operation of the yarn packaging apparatus 10, the turntable 20 is rotated and with operation of the yarn traversing apparatus, the yarn will be deposited on and formed in wave patterns on pad 20*a*. Simultaneous with formation of the revolutions of yarn, the nozzles 81*a*, 82*a* are radially reciprocated and operated to dispense dye material in overlapping wave patterns, A, A and B, B, as shown in FIG. 6, to create a random space dyed effect to the yarn.

By varying the elevation of the dye containers 87, 88 the pressure of dye material supplied to nozzles 81, 82 can be adjusted and with a controlled pressure, the valves 83, 84 could be open to allow a controlled continuous flow of dye material during rotation of the turntable.

After the yarn package has been formed and dyed, the packaging container 200 is utilized in doffing the package for additional yarn processing operations, such as fixation of the dye material and rewinding the yarn.

It now becomes apparent that the above described illustrative embodiment is capable of obtaining the above stated objects and advantags. It is obvious that those skilled in the art may make modification in the details of construction without departing from the spirit of the invention which is to be limited only by the scope of the appended claims.

What is claimed is:

1. An improved method for random or space dyeing yarn while simultaneously forming a package of yarn including the steps of:

rotating a support means about an axis;

advancing a length of yarn along its length on to the support means adjacent the axis of rotation of the support means during cyclic of rotation of the support means;

effecting a rectilinear radial reciprocating displacement of the length of yarn as the yarn moves along its length toward the support means during the cyclic rotation of the support means to cause the yarn to form an annular build up of yarn on the support means in a sinusoidal wave pattern with portions of the yarn displaced at various radial distances from and concentrically around the axis of rotation of the support means;

applying dye material to the revolutions of yarn as the yarn continues to move onto the support means; and continuing the cycles of rotation of the rotatable support means, the rectilinear radial reciprocating displacement of the length of yarn during successive cycles of rotation and the dye application to each revolution to cause a number of overlapping layers of sinusoidal wave patterns of yarn to be axially formed relative to each other to develop an annular porous package of yarn and to include a random or space dye pattern in the yarn.

2. An improved method as defined in claim 1 wherein the step of applying dye material to the revolutions of yarn comprises applying dye material to the yarn at a plurality of radially spaced portions of the yarn in each revolution of the yarn in the annular build up of yarn on the support means.

3. An improved method as defined in claim 1 and wherein the step of applying dye material to the revolutions of yarn comprises applying liquid dye to the upper surface of the annular build up of yarn at at least two radially spaced locations on the annular build up of yarn, between the inner peripheral edge of the annular build up of yarn and the outer peripheral edge of the annular build up of yarn

4. An improved method as defined in claim 1 and wherein the step of applying dye material to the revolutions of yarn comprises applying liquid dye to the upper surface of the annular build up of yarn at three radially spaced locations on the annular build up of yarn to produce three adjacent, circular paths of dye in response to the rotation of the yarn support means with the circular paths being concentric to the axis of rotation of the support means.

5. An improved method as defined in claim 1 and wherein the step of applying dye material to the revolutions of yarn comprises periodically injecting liquid dye into the upper surface of the annular build up of yarn during each revolution of the support means at radially spaced locations from the axis of rotation of the support means to form concentric arcuate paths of dye in response to cyclic rotation of said rotatable support means.

6. An improved method as defined in claim 1 and wherein the step of applying dye material to the revolutions of yarn comprises applying liquid dye to the upper surface of the annular build up of yarn at a rate corresponding to the rate of movement of the yarn beneath the position where the dye is applied.

7. A method of simultaneously space dyeing yarn and forming an annular package of space dyed yarn comprising urging a pressure plate and a yarn support surface toward each other, rotating the yarn support surface and the pressure plate with respect to each other, guiding a length of yarn along its length into the space between the pressure plate and the yarn support surface and progressively accumulating the yarn on the yarn support surface in an annular-shaped accumulation at a rate of accumulation corresponding to the speed of relative rotation of the pressure plate and the yarn support surface, oscillating the yarn toward and away from the axis of relative rotation of the pressure plate and the yarn support surface as the yarn approaches the space between the yarn support surface and the pressure plate at an oscillation speed sufficient to form the yarn in a plurality of sinusoidal waves in each layer of yarn accumulated on the yarn support surface, and applying dye material through the pressure plate to the surface of the yarn accumulated on the yarn support surface as the yarn support surface and the pressure plate rotate with respect to each other and as the yarn is progressively accumulated on the support surface.

8. The method of claim 7 and wherein the step of applying dye material to the yarn accumulated on the yarn support surface comprises applying different colors of dye material at different radial spacing from the center of the annular accumulation of yarn.

9. A method of forming an annular-shaped yarn package of spaced dyed yarn comprising urging a pressure plate and a yarn support surface toward each other, rotating the yarn support surface with respect to the pressure plate, guiding a length of yarn along its length through an opening in the pressure plate and onto the yarn support surface away from the axis of rotation of the yarn support surface so that the rotation of the yarn support surface with respect to the pressure plate draws the yarn onto the yarn support surface in an annular accumulation of yarn, oscillating the yarn toward and away from the axis of rotation of the yarn support surface as the yarn is drawn into the space between the support surface and the pressure plate with the ratio of the speed of oscillation to the speed of rotation of the yarn support surface sufficient to cause the yarn to form a plurality of sinusoidal waves in each layer of yarn on the yarn support surface, whereby the yarn is drawn onto the yarn support surface at a rate corresponding to the speed of rotation of the yarn support surface with respect to the pressure plate and the distance from the axis of rotation that the yarn is drawn onto the yarn support surface, and applying dye material to the yarn accumulated in the space between the yarn support surface and the pressuure plate in a circular pattern on the annular accumulation of yarn as the yarn support surface rotates with respect to the pressure plate and as the yarn is guided toward the support surface and drawn onto the yarn support surface.

* * * * *